US005383519A

United States Patent [19]

Wright et al.

[11] Patent Number: 5,383,519

[45] Date of Patent: Jan. 24, 1995

[54] APPARATUS FOR ROTATING A TUBING STRING OF A PUMPING WELLHEAD

[75] Inventors: James A. Wright, Sherwood Park; Curtis P. Ring, Edmonton, both of Canada

[73] Assignee: 569396 Alberta Ltd., Sherwood Park, Canada

[21] Appl. No.: 101,751

[22] Filed: Aug. 4, 1993

[51] Int. Cl.[6] ..... E21B 33/04

[52] U.S. Cl. ..... 166/78; 166/104; 166/117.7; 166/241.6

[58] Field of Search ..... 166/78, 92, 104, 117.7, 166/241.3, 241.6, 330, 331, 369

[56] References Cited

U.S. PATENT DOCUMENTS

| | | | |
|---|---|---|---|
| 1,650,102 | 11/1927 | Tschappat | 166/78 |
| 1,662,984 | 3/1928 | Scott et al. | 166/78 |
| 2,294,061 | 8/1942 | Williamson | 166/78 |
| 2,471,198 | 5/1949 | Cormany | 166/78 |
| 2,595,434 | 5/1952 | Williams | 166/78 |
| 2,599,039 | 6/1952 | Baker | 166/78 |
| 2,630,181 | 3/1953 | Solum | 166/78 |
| 2,693,238 | 11/1954 | Baker | 166/78 |
| 2,788,073 | 4/1957 | Brown | 166/78 |
| 3,494,638 | 2/1970 | Todd et al. | 285/93 |
| 5,139,090 | 8/1992 | Land | 166/369 |

FOREIGN PATENT DOCUMENTS

| | | | |
|---|---|---|---|
| 896339 | 3/1972 | Canada | 166/47 |
| 0535277A1 | 7/1993 | European Pat. Off. | E21B 3/04 |

OTHER PUBLICATIONS

Lacy, R. D., The Rotating Tubing Hanger System: A Unique New System, Technical Paper SPE-23977, presented 1992 SPE Permian Basin Oil and Gas Recovery Conference, Midland, Tex., Mar. 18-20, 1992.

Brochure, National Oilwell Canada Ltd., Variperm Packers.

Brochure, Salesbook, Toolmasters, Model S Dual String Anchor and Model T Rotating Sub.

Brochure, Rotating Production Systems (Canada) Inc., Production Rotating Systems.

*Primary Examiner*—Roger J. Schoeppel

*Attorney, Agent, or Firm*—Anthony R. Lambert

[57] ABSTRACT

An apparatus for rotating a tubing string of a pumping wellhead is described which includes a housing having a first end, a second end, and an interior. The first end has a stationary external coupling communicating with the interior. The second end is adapted for attachment to a wellhead. A drive assembly is disposed in the interior. The drive assembly includes a rotatable tubular member having a first end and a second end. The first end of the tubular member is disposed within the interior of the housing in fluid communication with the stationary external coupling. The second end of the tubular member extends past the second end of the housing thereby providing a rotatable coupling engagable with a tubing string. The drive assembly rotates the tubular member. Bearings are disposed between the tubular member and the interior of the housing thereby facilitating rotation of the tubular member. Dynamic seals are disposed between the tubular member and the interior of the housing.

9 Claims, 1 Drawing Sheet

APPARATUS FOR ROTATING A TUBING STRING OF A PUMPING WELLHEAD

BACKGROUND OF THE INVENTION

Apparatus for rotating a tubing string of a pumping wellhead are commonly referred to as "rotating wellhead systems". The tubing string is rotated in order to reduce wear on the inside of the tubing caused by sucker rod movement.

U.S. Pat. No. 5,139,090 which was issued to Land in 1992 provides an example of a rotating wellhead system. The Land reference describes a tubing rotator attached to the wellhead by means of an adaptor. An upper swivel is positioned above the tubing rotator and a lower or downhole swivel is positioned below the tubing rotator.

Rotating wellhead systems, such as illustrated in the Land, reference have a number of problems. One problem is the entry of water through the top of the unit. If such water freezes, it destroys the rotating wellhead system. Another problem relates to the danger that excessive torque will be placed upon a fluid flow line rotating wellhead system. A final problem is that height that such rotating wellhead systems add to the wellhead. It is desirable that the rotating wellhead system be as compact as possible, so not to make it difficult for a person to perform a ground level check on the wellhead.

SUMMARY OF THE INVENTION

What is required is an apparatus for rotating a tubing string of a pumping wellhead which addresses the deficiencies in the prior art.

According to the present invention there is provided an apparatus for rotating a tubing string of a pumping wellhead which includes a housing having a first end, a second end, and an interior. The first end has a stationary external coupling communicating with the interior. The second end has means for attaching the housing to a wellhead. A drive assembly is disposed in the interior. The drive assembly includes a rotatable tubular member having a first end and a second end. The first end of the tubular member is disposed within the interior of the housing in fluid communication with the stationary external coupling. The second end of the tubular member extends past the second end of the housing thereby providing a rotatable coupling engagable with a tubing string. The drive assembly includes means for rotating the tubular member. Bearing means are disposed between the tubular member and the interior of the housing thereby facilitating rotation of the tubular member. Dynamic seals are disposed between the tubular member and the interior of the housing.

The apparatus, as described, incorporates within its design a combination of a tubing rotator and upper swivel, thereby combining functions performed by two apparatus in the Land reference in a single apparatus. This decreases the height of rotating wellhead system by approximately 12 inches, and makes it easier to perform ground level inspections. With the first end of the tubular member disposed within the interior of the housing, there is no possibility of water leaking into the housing as a result of rain or snow. With the top of the housing remaining stationary, no torque is placed on any fluid flow lines attached to the housing or above the housing. The design also simplifies servicing and provides numerous other advantages which will be apparent from the description which follows.

Although beneficial results may be obtained through the use of the apparatus, as described, when a gas pocket is encountered annulus pressure rises dramatically, this can result in a failure of dynamic seals and an uncontrolled flow of gas from the wellhead. Such conditions pose an environmental threat, a fire danger and a safety concern. Even more beneficial results may, therefore, be obtained when the housing is sealed such that any leakage through the dynamic seals is contained within the interior of the housing.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
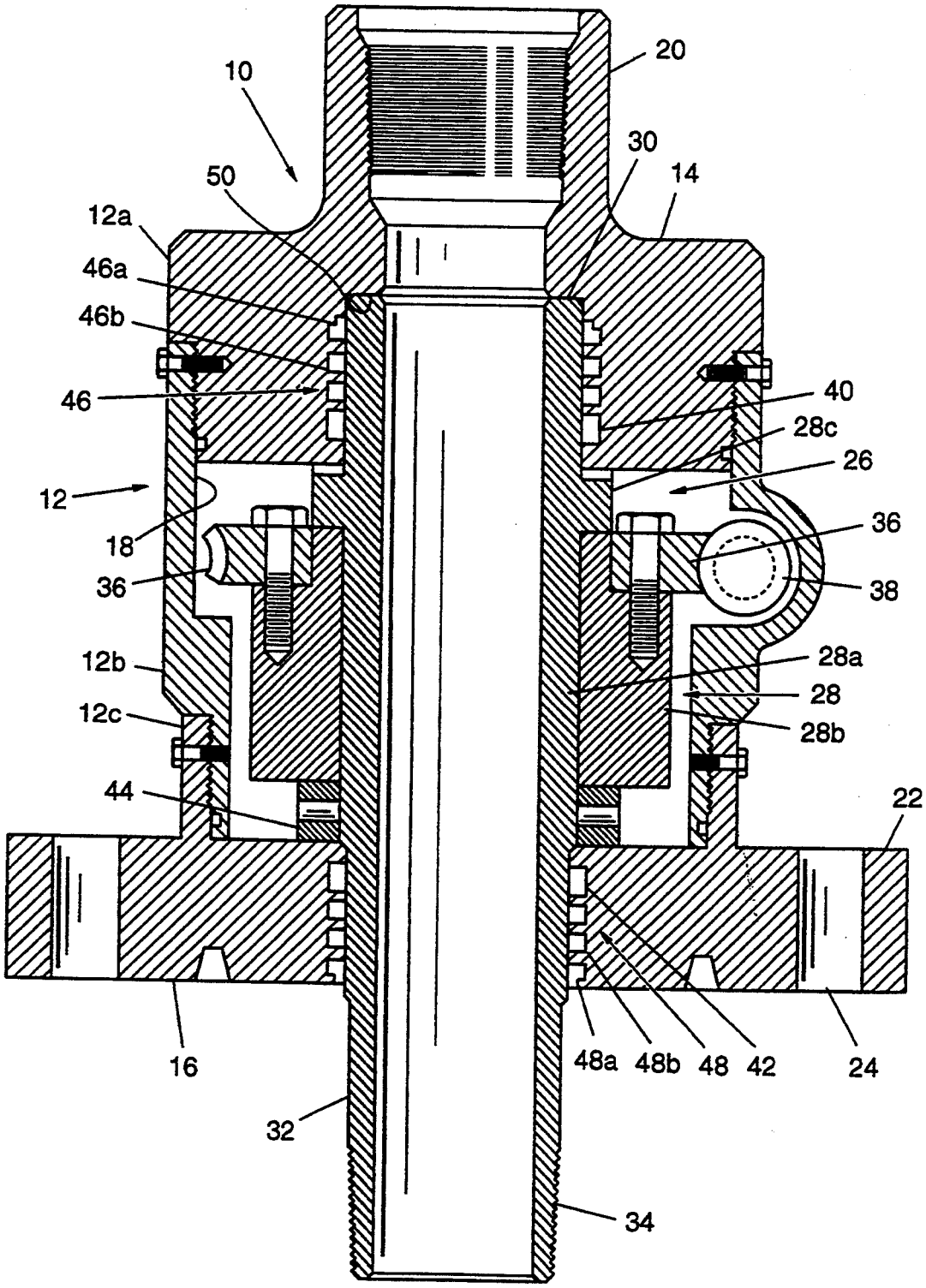
FIG. 1 is a side elevation view in longitudinal section of an apparatus constructed in accordance with the teachings of the present invention.

The preferred embodiment, an apparatus for rotating a tubing string of a pumping wellhead generally identified by reference numeral 10, will now be described with reference to FIG. 1.

Apparatus 10 includes a housing 12 having a first end 14, a second end 16, and an interior 18. First end 14 has a stationary external box coupling 20 communicating with interior 18. Second end 16 has a flange 22 with bolt receiving openings 24 whereby housing 12 is attached to a wellhead (not shown). For ease of assembly and servicing housing 12 is constructed of three components **12*a*, 12*b*, and 12*c*. These three components have sealed connections, such that housing 12 is sealed to the atmosphere. A drive assembly, generally indicated by reference numeral 26, is disposed in interior 18. Drive assembly 26 includes a rotatable tubular member 28 having a first end 30 and a second end 32. First end 30 is in fluid communication with stationary external box coupling 20. Second end 32 of tubular member 28 extends past second end 16 of housing 12 thereby providing a rotatable coupling engagable with a tubing string (not shown). Second end 32 has external threads 34 to facilitate such attachment. For ease of assembly and servicing tubular member 28 is constructed of two components a barrel portion 28*a* and a sleeve portion 28*b*. Barrel portion 28*a* has an annular shoulder 28*c* which engages sleeve portion 28*b*. Tubular member 28 has an annular gear 36 which intermeshes with a drive gear 38. A rotational force provided by a motor (not shown) to drive gear 38 acts upon annular gear 36 to rotate tubular member 28. A first radial bearing 40 is disposed between tubular member 28 and interior 18 adjacent first end 14 of housing 12. A second radial bearing 42 is disposed between tubular member 28 and interior 18 adjacent second end 16 of housing 12. A thrust bearing 44 is disposed between tubular member 28 and interior 18. A plurality of dynamic seals 46 and 48 are disposed between tubular member 28 and interior 18 of housing 12. There are a first series of seals 46*a* disposed in seal grooves 46*b* in interior 18 adjacent first end 14 of housing 12 and a second series of seals 48*a* disposed in seal grooves 48*b* in interior 18 adjacent second end 16 of housing 12. An annular shoulder 50 is positioned in interior 18 adjacent first end 14 of housing 12** substantially axially aligned with stationary external coupling 20. First end 30 of tubular member 28 engages annular shoulder 50. If improved sealing is desired face seals can be placed on annular shoulder 50 and first end 30 of tubular member 28.

The use and operation of apparatus 10 will now be described with reference to FIG. 1. There is a flow of fluids up tubular member 28 from second end 32 to first end 30. Fluids flowing from first end 30 of tubular member 28 flow into stationary external box coupling 20. Under normal conditions there are no well fluids within that portion of interior 18 of housing 12 in which gears 36, 38 and bearings 40, 42, 44 are positioned. A drive motor (not shown) provides a rotational force to drive gear 38. Drive gear 38 acts upon annular gear 36 to rotate tubular member 28. As tubular member 28 rotates the tubing string attached to second end 32 of tubular member 28 is, in turn, rotated. Dynamic seals 46 and 48 provide a seal between rotating tubular member 28 and interior 18 of housing 12. This maintains lubricant for drive gear 38, annular gear 36, and bearings 40, 42, and 44 within interior 18 of housing 12. This also prevents the flow of fluid up the annulus and between tubular member 28 and housing 12. Should there be a dramatic increase in pressure which is more than dynamic seals 46 and 48 are capable of withstanding, pressure leaks are contained within housing 12. Any leakage from interior 18, which may pass between first end 30 of tubular member 28 and annular shoulder 50, merely passes through stationary external box coupling 20. Even this leakage can be prevented, if desired, by placing face seals on annular shoulder 50 and first end 30 of tubular member 28. Of course, in the event of a failure of dynamic seals 46 and 48, the incursion of abrasive fluids will be harmful to the drive assembly. In such event, apparatus 10 should be serviced as soon as practicable.

Apparatus 10, as described, combines the upper swivel and the tubing rotator. This makes the height of apparatus 10 approximately one foot less than the previous configuration. Minor maintenance can be preformed to apparatus 10 without removing the same from the wellhead. This is accomplished by separating components 12*a* and 12*b*. In addition, means is provided to contain pressure leaks. It will be apparent to one skilled in the art, however, that modifications may be made to the illustrated embodiment without departing from the spirit and scope of the invention as defined by the claims. In particular, there are alternative drive systems which may be employed.

We claim:

1. An apparatus for rotating a tubing string of a pumping wellhead, comprising:

a. a housing having a first end, a second end, and an interior, the first end having a stationary external coupling communicating with the interior, the second end having means for attaching the housing to a wellhead;

b. a drive assembly disposed in the interior, the drive assembly including a rotatable tubular member having a first end and a second end, the first end of the tubular member being disposed within the interior of the housing in fluid communication with the stationary external coupling, the second end of the tubular member extending past the second end of the housing thereby providing a rotatable coupling engagable with a tubing string, the drive assembly including means for rotating the tubular member;

c. bearing means disposed between the tubular member and the interior of the housing thereby facilitating rotation of the tubular member, the bearing means including a first radial bearing disposed between the tubular member and the interior adjacent the first end of the housing and a second radial bearing disposed between the tubular member and the interior adjacent the second end of the housing; and d. dynamic seals disposed between the tubular member and the interior of the housing to seal fluids within the housing.

2. The apparatus as defined in claim 1 further including means to seal the housing such that any leakage through the dynamic seals is contained within the interior of the housing.

3. The apparatus as defined in claim 1, an annular shoulder being positioned in the interior adjacent the first end of the housing substantially axially aligned with the stationary external coupling, the first end of the tubular member engaging the annular shoulder.

4. The apparatus as defined in claim 3, the bearing means including at least one thrust bearing supporting the tubular member on the wellhead.

5. The apparatus of claim 4 in which the thrust bearing is disposed, in an axial direction, between the first radial bearing and the second radial bearing.

6. The apparatus as defined in claim 1, the tubular member having an annular gear intermeshed with a drive gear, such that a rotational force provided by a motor to the drive gear acts upon the annular gear to rotate the tubular member.

7. The apparatus as defined in claim 1, the sealing means including a first series of seals disposed in seal grooves in the interior adjacent the first end of the housing and a second series of seals disposed in seal grooves in the interior adjacent the second end of the housing, such that the first series of seals and the second series of seals sealingly engage the tubular member.

8. The apparatus of claim 1 in which the bearing means includes at least one thrust bearing supporting the tubular member on the wellhead and the thrust bearing is disposed, in an axial direction, between the first radial bearing and the second radial bearing.

9. An apparatus for rotating a tubing string of a pumping wellhead, comprising:

a. a housing having a first end, a second end, and an interior, the first end having a stationary external box coupling communicating with the interior, the second end having a flange with bolt receiving openings whereby the housing is attached to a wellhead;

b. a drive assembly disposed in the interior, the drive assembly including a rotatable tubular member having a first end and a second end, the first end of the tubular member being in fluid communication with the stationary external coupling, the second end of the tubular member extending past the second end of the housing thereby providing a rotatable coupling engagable with a tubing string, the tubular member having an annular gear intermeshed with a drive gear, such that a rotational force provided by a motor to the drive gear acts upon the annular gear to rotate the tubular member;

c. a first radial bearing disposed between the tubular member and the interior adjacent the first end of the housing, a second radial bearing disposed between the tubular member and the interior adjacent the second end of the housing, and a thrust bearing disposed between tubular member and the interior;

d. dynamic seals disposed between the tubular member and the interior of the housing, including a first series of seals disposed in seal grooves in the interior adjacent the first end of the housing and a second series of seals disposed in seal grooves in the interior adjacent the second end of the housing;

e. an annular sealing shoulder being positioned in the interior adjacent the first end of the housing substantially axially aligned with the stationary external coupling, the first end of the tubular member engaging the annular sealing shoulder; and f. the housing being sealed such that any leakage through the dynamic seals is contained within the interior of the housing.

* * * * *